US008517531B2

(12) United States Patent
Fan Chiang

(10) Patent No.: US 8,517,531 B2
(45) Date of Patent: Aug. 27, 2013

(54) PRINTER

(75) Inventor: Kai Fan Chiang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 263 days.

(21) Appl. No.: 13/197,766

(22) Filed: Aug. 3, 2011

(65) Prior Publication Data

US 2012/0291646 A1 Nov. 22, 2012

(30) Foreign Application Priority Data

May 18, 2011 (TW) ..... 100117492 A

(51) Int. Cl.
*B41J 29/13* (2006.01)

(52) U.S. Cl.
USPC ..... 347/108; 400/693

(58) Field of Classification Search
CPC ..... B41J 29/13
See application file for complete search history.

(56) References Cited

U.S. PATENT DOCUMENTS 7,768,798 B2 * 8/2010 Aono et al. ..... 361/818

* cited by examiner

*Primary Examiner* — Stephen Meier
*Assistant Examiner* — Tracey McMillion
(74) *Attorney, Agent, or Firm* — Altis Law Group, Inc.

(57) ABSTRACT

A printer includes a main body, a guiding plate secured within the main body, a cover rotatably connected to the main body and including at least one resisting block, and a shielding assembly arranged between the cover and the guiding plate. The printer includes a shielding plate rotatably connected to the main body and at least one elastic element secured to the shielding plate. The shielding plate is in an upright state when no external force is exerted on the shielding plate. When the cover is rotated to cover the main body, the resisting block resists the elastic element, causing the shielding plate to rotate from the upright state to a horizontal state, and causing a portion of the shielding plate to contact the guiding plate.

5 Claims, 4 Drawing Sheets

PRINTER

BACKGROUND

1. Technical Field

The present disclosure relates to printers.

2. Description of Related Art

A conventional inkjet printer includes a main body, a cover rotatably connected to the main body, a guiding plate to guide a printed paper to move out of the printer, an ink box disposed on the guiding plate, and a paper tray. The cover defines an opening. A printed paper can be ejected from the opening into the paper tray. When the cover is rotated to cover the main body, the space between the cover and the guiding plate is relatively great. When the printer is operating, ink from the ink box may fall into other elements of the printer through the space. Thus the printer may be contaminated by ink. Furthermore, foreign bodies may enter the ink box through the opening and the space to damage the ink box. Therefore, there is a need to provide a new printer to solve the above problems.

BRIEF DESCRIPTION OF THE DRAWINGS

The components of the drawings are not necessarily drawn to scale, the emphasis instead being placed upon clearly illustrating the principles of the printer. Moreover, in the drawings, like reference numerals designate corresponding parts throughout several views.

DETAILED DESCRIPTION

Figure 1:
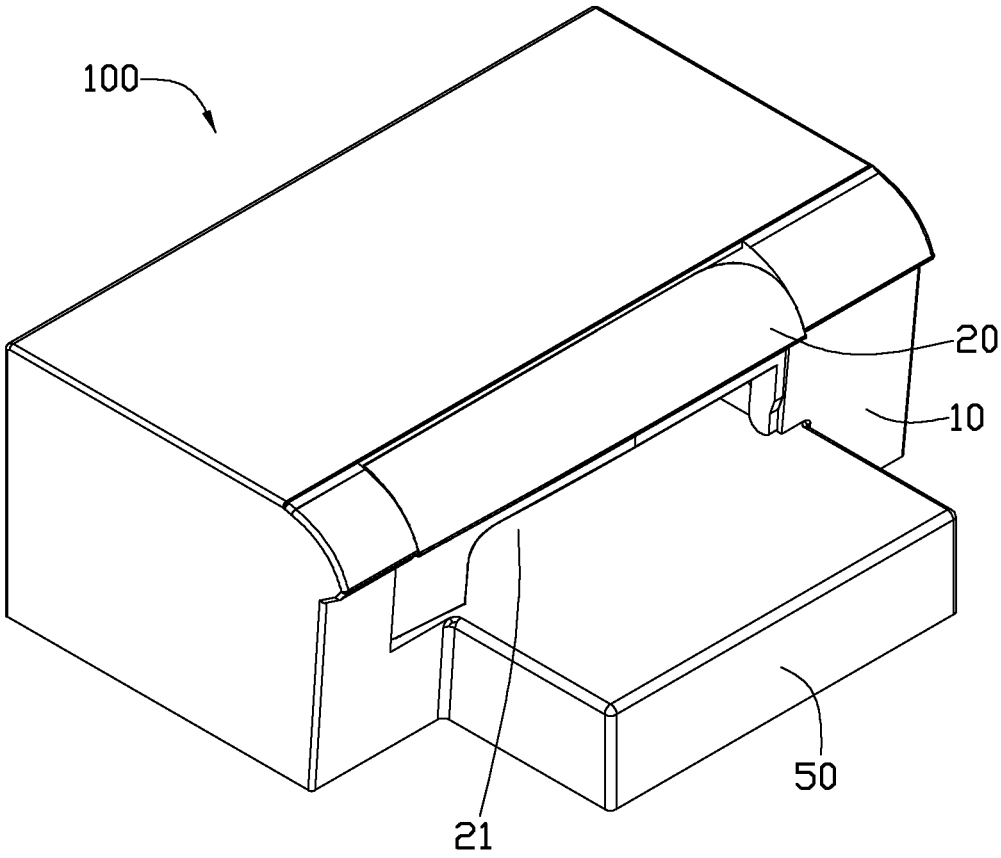
FIG. 1 is an isometric view of a printer in accordance with an exemplary embodiment, showing the printer covered by a cover.
Figure 2:
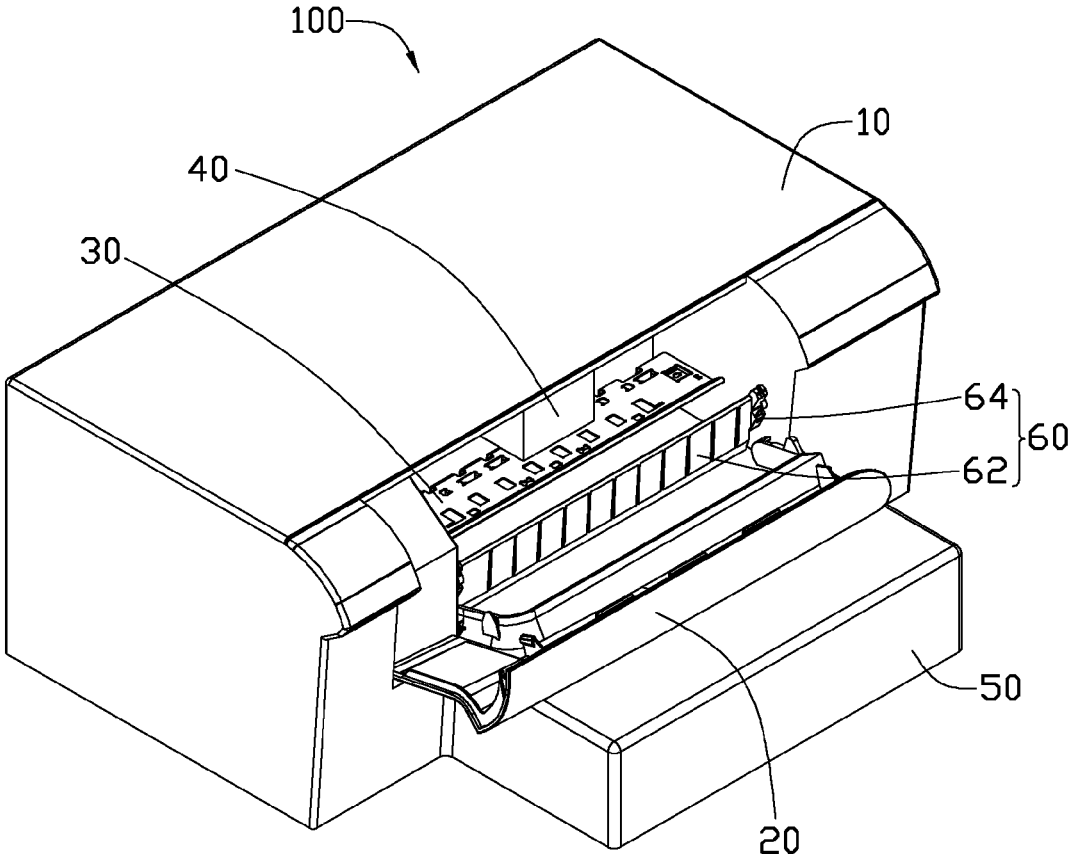
FIG. 2 is another isometric view of the printer of FIG. 1, showing the cover opened.
Figure 3:
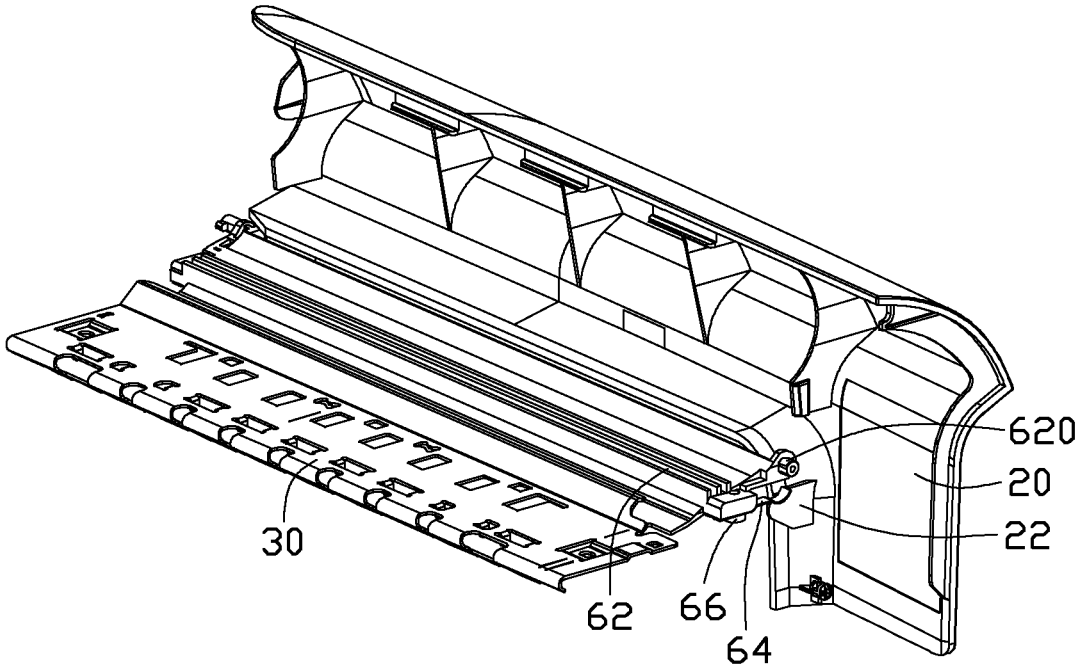
FIG. 3 is an isometric view of an interior structure of the printer.

Referring to FIGS. 1-3, a printer 100 includes a main body 10, a cover 20 rotatably connected to the main body 10, a guiding plate 30 secured within the main body 10, an ink box 40 disposed on the guiding plate 30, and a paper tray 50. The guiding plate 30 is used to guide a printed paper out of the printer 100 through an opening 21 defined in the cover 20 into the paper tray 50. In this embodiment, at least one resisting block 22 protrudes from the cover 20.

In this embodiment, the printer 100 further includes a shielding assembly 60. The shielding assembly 60 includes a shielding plate 62 and at least one elastic element 64 secured to the shielding plate 62. The shielding plate 62 is rotatably connected to the main body 10 and is arranged between the cover 20 and the guiding plate 30. Two opposite sidewalls (not labeled) of the shielding plate 62 respectively include shafts 620. The shielding plate 62 is rotatably connected to the main body 10 via the shafts 620. The shielding plate 62 is in an upright state when no external force is exerted on the shielding plate 62. When the cover 20 is rotated to cover the main body 10, the resisting block 22 resists the elastic element 64, causing the shielding plate 62 to rotate from the upright state to a horizontal state, and causing a portion of the shielding plate 62 to contact to the guiding plate 30. When the cover 20 is rotated to an open state, the resisting block 22 disengages from the elastic element 64, causing the shielding plate 62 to rotate from the horizontal state to the upright state.

In this embodiment, when the cover 20 covers the main body 10, the shielding plate 62 is in the horizontal state, thus the shielding plate 62 can prevent ink from the ink box 40 falling into and contaminating other elements of the printer 100. Furthermore, the shielding plate 62 contacts the cover 20 and the guiding plate 30 when in the horizontal state, thus preventing foreign bodies from entering the ink box 40 through the opening 21 while the ink box 40 is operating. A portion of the shielding plate 62 contacts the guiding plate 30 when the shielding plate 62 is in the horizontal state, thus the shielding plate 62 will not hinder a printed paper from ejecting from the printer 100. The shielding plate 62 is in the upright state when the cover 20 is in the open state, thus a user can conveniently replace the ink box 40.

Figure 4:
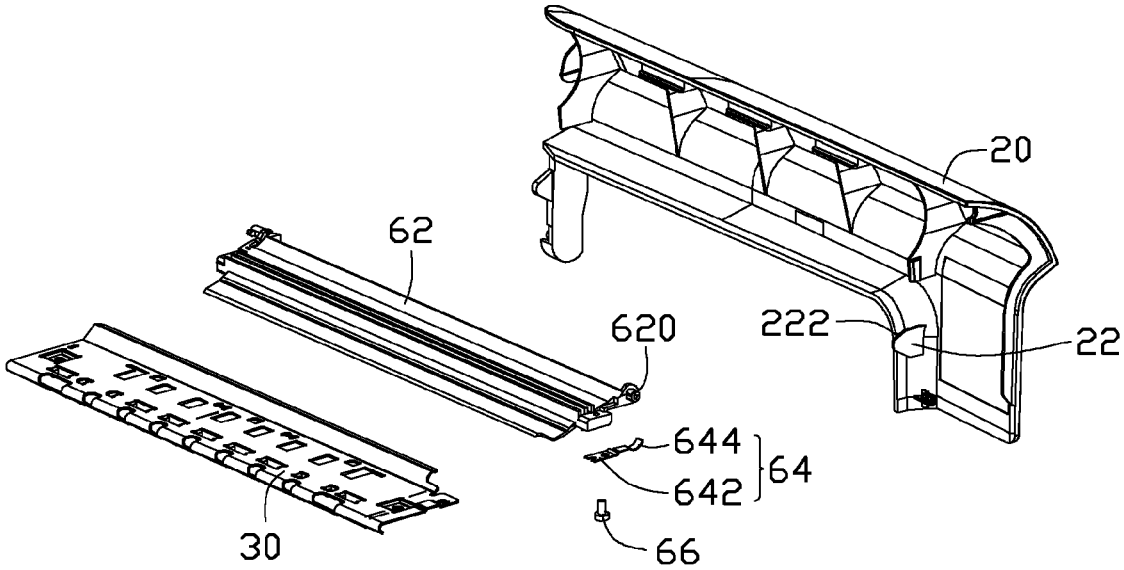
FIG. 4 is an exploded, perspective view of the interior structure of FIG. 3.

Referring also to FIG. 4, the elastic element 64 includes a fixing end 642 and a free end 644. The fixing end 642 is secured to the shielding plate 62 with a fixing element 55. The free end 644 is bent toward the shielding plate 62. The fixing end 642 is farther away from the shaft 620 than the free end 644. In this embodiment, two elastic elements 64 are employed. The elastic elements 64 are substantially parallel to each other and respectively adjacent to the shafts 620. In this embodiment, the resisting block 22 includes an inclined sidewall 222 extending from the top of the resisting block 22. When the cover 20 covers the main body 10, the inclined sidewall 222 resists the free end 644 to cause the shielding plate 62 to be in the horizontal state and cause a portion of the shielding plate 62 to contact the guiding plate 30. In this embodiment, the cover 20 includes two resisting blocks 22 parallel to each other.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A printer comprising:

a main body;

a guiding plate secured within the main body;

a cover rotatably connected to the main body and comprising at least one resisting block facing the guiding plate; and a shielding assembly arranged between the cover and the guiding plate, and comprising a shielding plate rotatably connected to the main body and at least one elastic element secured to the shielding plate, wherein the shielding plate is in an upright state when no external force is exerted on the shielding plate, when the cover is rotated to cover the main body, the at least one resisting block resists the at least one elastic element, causing the shielding plate to rotate from the upright state to a horizontal state, and causing a portion of the shielding plate to contact the guiding plate, when the cover is rotated to an open state, the at least one resisting block disengages from the at least one elastic element, causing the shielding plate to rotate from the horizontal state to the upright state.

2. The printer as described in claim 1, wherein each of the at least one resisting block comprises an inclined sidewall extending from a top of the one of the at least one resisting block, each of the at least one elastic element comprises a fixing end and a free end, the fixing end of each of the at least one elastic element is secured to the shielding plate, when the cover is rotated to cover the main body, the inclined sidewall of each of the at least one resisting block resists the free end of each of the at least one elastic element, causing the shielding plate to rotate from the horizontal state to the upright state, and causing a portion of the shielding plate to contact the guiding plate.

3. The printer as described in claim 2, wherein the free end of each of the at least one elastic element is bent toward the shielding plate.

4. The printer as described in claim 1, wherein the at least one resisting block comprises two resisting blocks, and the at least one elastic element comprises two elastic elements.

5. The printer as described in claim 1, wherein the shielding plate comprises two opposite shafts, and the shielding plate is rotatably connected to the main body with the shafts.

* * * * *